US007958854B2

(12) United States Patent
Al-Shawaf et al.

(10) Patent No.: US 7,958,854 B2
(45) Date of Patent: Jun. 14, 2011

(54) MULTI-STAGE COOLING SYSTEM

(75) Inventors: Mustafa Al-Shawaf, Washington, IL (US); Rishabh Sinha, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 490 days.

(21) Appl. No.: 12/149,870

(22) Filed: May 9, 2008

(65) Prior Publication Data

US 2009/0277601 A1 Nov. 12, 2009

(51) Int. Cl.
*F01P 3/00* (2006.01)

(52) U.S. Cl. ..... 123/41.29; 60/599; 123/41.08; 123/563

(58) Field of Classification Search ..... 123/41.01, 123/41.02, 41.08, 41.11, 41.29, 41.58, 563, 123/41.31, 41.1; 60/599
See application file for complete search history.

(56) References Cited

U.S. PATENT DOCUMENTS

| | | | | |
|---|---|---|---|---|
| 2,756,026 | A | 7/1956 | Myrent et al. | |
| 3,411,316 | A | 11/1968 | Wright | |
| 4,325,219 | A | 4/1982 | Stang et al. | |
| 4,348,991 | A | 9/1982 | Stang et al. | |
| 4,385,594 | A | 5/1983 | Hauser, Jr. | |
| 4,485,624 | A * | 12/1984 | Melchior | 60/599 |
| 4,620,509 | A | 11/1986 | Crofts | |
| 5,201,285 | A * | 4/1993 | McTaggart | 123/41.31 |
| 5,215,044 | A * | 6/1993 | Banzhaf et al. | 123/41.29 |
| 5,415,147 | A * | 5/1995 | Nagle et al. | 123/563 |
| 6,145,480 | A | 11/2000 | Betz et al. | |
| 7,228,885 | B2 | 6/2007 | Kolb et al. | |
| 7,310,946 | B2 * | 12/2007 | Rogg et al. | 60/599 |
| 7,464,700 | B2 * | 12/2008 | Kolb | 123/563 |
| 2003/0033993 | A1 * | 2/2003 | Valaszkai et al. | 123/41.31 |
| 2003/0106669 | A1 | 6/2003 | Ambros et al. | |
| 2003/0221638 | A1 * | 12/2003 | Haase | 123/41.01 |
| 2004/0045749 | A1 | 3/2004 | Jaura et al. | |
| 2006/0185362 | A1 * | 8/2006 | Rogg et al. | 60/599 |

FOREIGN PATENT DOCUMENTS

| | | |
|---|---|---|
| EP | 0522288 | 9/1994 |
| JP | 2003185384 | 7/2003 |

OTHER PUBLICATIONS

Dr.Win Lei Lei Phyu, "Green Car Congress", www.greencarcongress.com/2007/09/scania-introduc.html, Sep. 5, 2007, 3 pages.

* cited by examiner

*Primary Examiner* — Michael Cuff
*Assistant Examiner* — Hung Q Nguyen
(74) *Attorney, Agent, or Firm* — Finnegan, Henderson, Farabow, Garrett & Dunner LLP

(57) ABSTRACT

A cooling system is provided having a first heat exchanger configured to remove heat from at least a portion of a first fluid and a second heat exchanger configured to remove heat from a portion of a second fluid. The second heat exchanger is located downstream of the first heat exchanger relative to the flow of air passing through the first heat exchanger so that a substantial portion of the air passing through the first heat exchanger also passes through the second heat exchanger. The cooling system also has a valve located to regulate the flow of the second fluid through the second heat exchanger. The cooling system further has a controller configured to actuate the valve to restrict the flow of the second fluid through the second heat exchanger when the first heat exchanger is removing heat from the first fluid.

20 Claims, 3 Drawing Sheets

MULTI-STAGE COOLING SYSTEM

TECHNICAL FIELD

The present disclosure is directed to a cooling system and, more particularly, to a multi-stage cooling system.

BACKGROUND

Machines, including track-type tractors, wheel loaders, haul trucks, and other construction and mining equipment, are used for a variety of tasks. In order to accomplish these tasks, the machines typically include an internal combustion engine such as a diesel engine, gasoline engine, or gaseous fuel-powered engine that produces significant amounts of power by combusting a fuel/air mixture. This combustion process generates large amounts of heat. In order to ensure proper and efficient operation of the engine, a cooling system is required to cool fluids directed into or out of the engine.

For example, an internal combustion engine is generally fluidly connected to several different liquid-to-air and/or air-to air heat exchangers to cool both liquids and gases circulated throughout the engine. These heat exchangers are often located close together and/or close to the engine to conserve space on the machine. A fan is disposed either in front of the engine/exchanger package to blow air across the exchangers and the engine, or between the exchangers and engine to suck air past the exchangers and blow air past the engine.

The size of the engine and power output of the engine may be at least partially dependent on the amount of cooling provided to the engine. That is, the engine may have a maximum temperature and a most efficient operating temperature range. Operation of the engine may be limited by the capacity of the associated exchangers to maintain the engine's temperatures below the maximum limit and within the optimum range. In addition, given the space constraints of a particular engine's enclosure, the size of the exchangers may also be limited. Therefore, it becomes necessary to maximize cooling efficiency for a given space constraint.

Maximizing cooling efficiency can be difficult, especially when multiple engine and non-engine heat exchangers are packaged together. That is, in some configurations, air-to-air after coolers (ATAAC) are co-located with engine heat exchangers to take advantage of the airflow generated by the fan. In these situations, the heat transfer from the ATAACs can affect the heat transfer from the engine's exchangers, as well as consume space within the engine's compartment.

One attempt to maximize machine cooling within a given engine compartment is disclosed in U.S. Pat. No. 7,228,885 (the '885 patent), issued to Kolb et al. on Jun. 12, 2007. The '885 patent describes a heat exchanger package for an engine system. The heat exchanger package includes a radiator having upper and lower portions for cooling engine coolant and a charge air cooler having upper and lower portions for cooling charge air. The upper charge air cooler portion is disposed adjacent to and overlapping the upper radiator portion. In addition, the lower charge air cooler portion is disposed adjacent to and overlapping the lower radiator portion. Furthermore, the upper charge air cooler portion and the lower radiator portion are aligned in a first plane, while the upper radiator portion and the lower charger air cooler portion are aligned in a second plane behind the first plane. Ambient cooling air flows in series through the upper charge air cooler portion and the upper radiator portion and in series through the lower charge air cooler portion and the lower radiator portion.

Although the cooling system of the '885 patent may provide a compact heat exchanger package, the efficiency and cooling capacity may be limited. In particular, the cooling system does not account for the changing relationship between the radiator and charge air heat loads of different engine operating conditions. For example, during some engine operating conditions, the radiator and charge air heat load may increase or decrease together. In other engine operating modes, the radiator and charge air heat loads may increase or decrease independently. Therefore, the '885 cooling system, may be efficient under certain engine operating conditions and inefficient under others.

The disclosed cooling system is directed to overcoming one or more of the problems set forth above.

SUMMARY

In one aspect, the present disclosure is directed to a cooling system. The cooling system includes a first heat exchanger configured to remove heat from at least a portion of a first fluid and a second heat exchanger configured to remove heat from a portion of a second fluid. The second heat exchanger is located downstream of the first heat exchanger relative to the flow of air passing through the first heat exchanger so that a substantial portion of the air passing through the first heat exchanger also passes through the second heat exchanger. The cooling system also includes a valve located to regulate the flow of the second fluid through the second heat exchanger. The cooling system further includes a controller configured to actuate the valve to regulate the flow of the second fluid through the second heat exchanger when the first heat exchanger is removing heat from the first fluid.

In another aspect, the present disclosure is directed to a method of cooling a fluid. The method includes directing at least a portion of a first fluid through a first heat exchanger and directing a portion of a second fluid through a second heat exchanger. In addition, the method includes directing air across the first and second heat exchangers so that both heat exchangers receive the air in series. Furthermore, the method includes sensing a parameter indicative of an operating condition of the first heat exchanger and regulating the flow of the second fluid through the second heat exchanger in response to the operating condition of the first heat exchanger.

DETAILED DESCRIPTION

Figure 1:
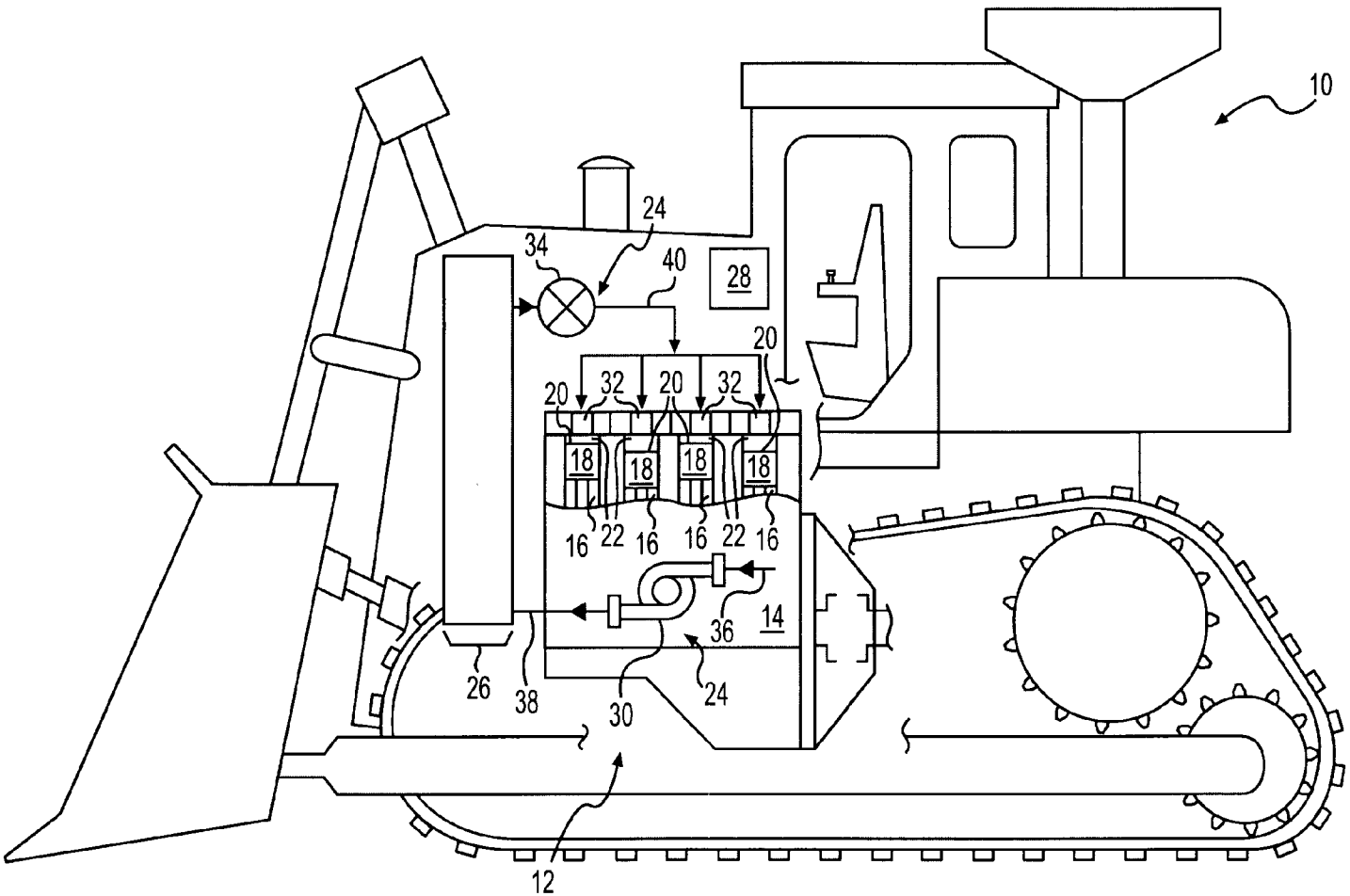
FIG. 1 is a diagrammatic illustration of an exemplary disclosed machine.

FIG. 1 illustrates a machine 10 having an engine 12. Machine 10 may perform some type of operation associated with an industry such as mining, construction, farming, power generation, or any other industry known in the art. For example, machine 10 may embody a machine such as a dozer, a loader, a backhoe, an excavator, a motor grader, a dump truck, or any other suitable earth moving machine. Machine 10 may alternatively embody a generator set, a pump, or another operation-performing machine.

Engine 12 may include multiple components that cooperate to produce a power output. In particular, engine 12 may include an engine block 14 that defines a plurality of cylinders 16, a piston 18 slidably disposed within each cylinder 16, and a cylinder head 20 associated with each cylinder 16. It is contemplated that engine 12 may include additional or different components such as, for example, a valve mechanism associated with cylinder head 20, one or more fuel injectors, and other components known in the art. For the purposes of this disclosure, engine 12 is depicted and described as a four-stroke diesel engine. One skilled in the art will recognize, however, that engine 12 may be any other type of internal combustion engine such as, for example, a gasoline or a gaseous fuel-powered engine.

Cylinder 16, piston 18, and cylinder head 20 may form a combustion chamber 22. Although the exemplary engine 12 illustrated in FIG. 1 includes four combustion chambers 22, it is contemplated that engine 12 may include a greater or lesser number of combustion chambers 22 and that combustion chambers 22 may be disposed in an "in-line" configuration, a "V" configuration, or any other suitable configuration.

As is also shown in FIG. 1, engine 12 may include a plurality of systems that facilitate production of the power output. In particular, engine 12 may include an air induction system 24, a cooling system 26, and a control system 28. It is contemplated that engine 12 may include additional systems such as, for example, an exhaust system, a fuel system, a lubrication system, a transmission system, and other such engine systems that are known in the art.

Air induction system 24 may introduce charged air into combustion chambers 22 of engine 12. In addition, air induction system 24 may include a compressor 30 of a turbocharger (not shown) in fluid communication with one or more inlet ports 32 of each cylinder head and a throttle valve 34. It is contemplated that additional and/or different components may be included within air induction system 24 such as, for example, an air cleaner and other means known in the art for introducing charged air into combustion chambers 22.

Compressor 30 may receive atmospheric air via an inlet 36 and compress the received air to a predetermined pressure level. In addition, compressor 30 may direct the compressed air to inlet ports 32 via fluid conduits 38, 40. Furthermore, compressor 30 may embody a fixed geometry compressor, a variable geometry compressor, or any other type of compressor known in the art. It is contemplated that multiple compressors 30 may alternatively be included within air induction system 24 and disposed in a series or parallel relationship, if desired. In such an embodiment utilizing multiple compressors, fluid conduit 40 may direct pre-charged air from the upstream compressors 30 to the compressor 30 that may be furthest downstream.

Throttle valve 34 may be located within fluid conduit 38 between compressor 30 and inlet ports 32 to control the amount of air delivered to combustion chambers 22. The location of throttle valve 34 may be any suitable position within fluid conduits 38, 40 such as, for example, before or after cooling system 26. In addition, throttle valve 34 may be adjustable from a flow-passing position, resisting a spring bias, toward a flow-restricting position. When in the flow-passing position, air may be directed into engine 12 substantially unrestricted. The term restricted, for the purposes of this disclosure, is to be interpreted as at least partially blocked from fluid flow. It is also contemplated that throttle valve 34, when in the flow-restricting position, may fully block fluid flow. Throttle valve 34 may include a butterfly valve element, a spool valve element, a shutter valve element, a check valve element, a diaphragm valve element, a gate valve element, a shuttle valve element, a ball valve element, a globe valve element, or any other type of valve element known in the art. In addition, throttle valve 34 may be electrically, hydraulically, or pneumatically actuated. It is contemplated that throttle valve 34 may be omitted, if desired.

Figure 2:
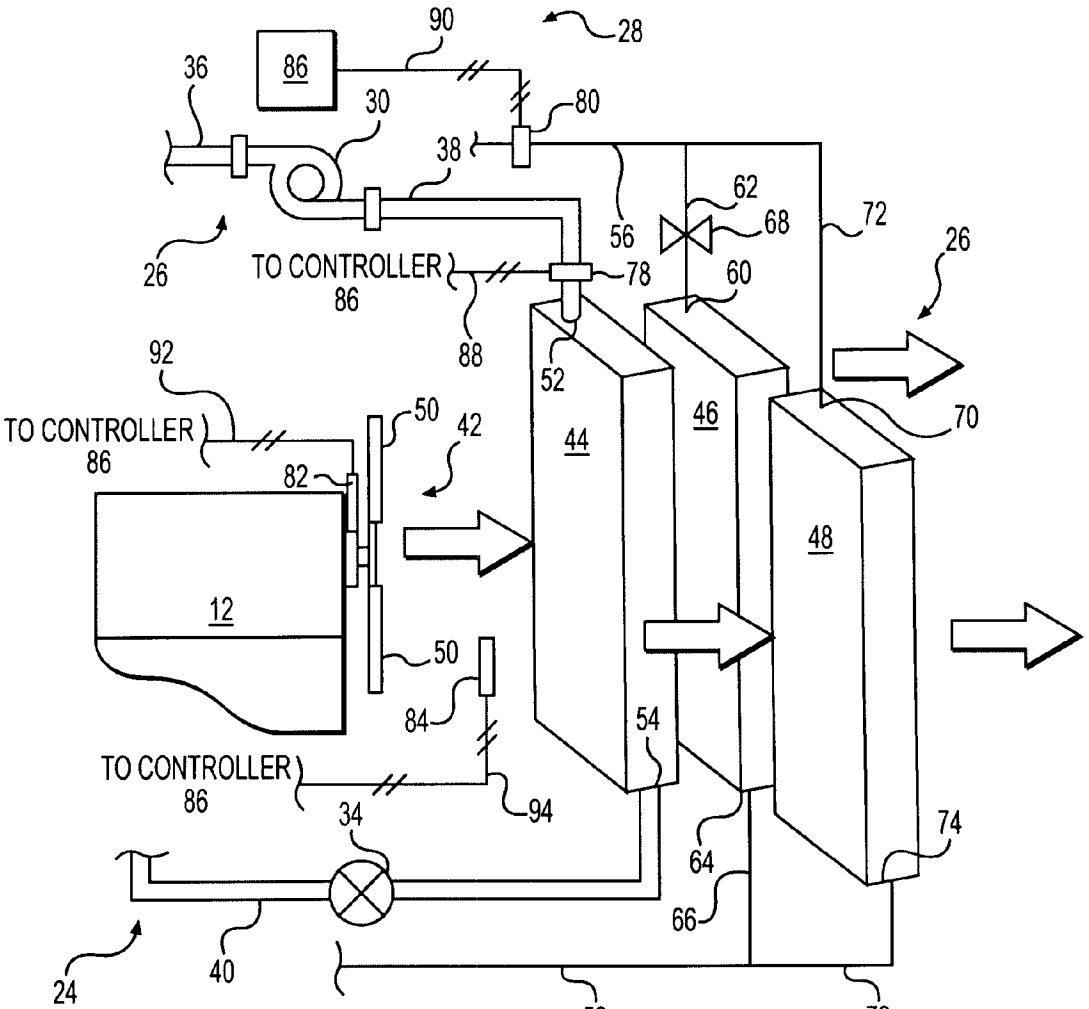
FIG. 2 is a pictorial and schematic illustration of an exemplary disclosed cooling system for use with the machine of FIG. 1.

As illustrated in FIG. 2, cooling system 26 may include components that collaborate to cool fluids directed through engine 12. For example, cooling system 26 may include a fan 42 for generating a flow of air across a plurality of heat exchangers, an air-to-air heat exchanger 44 for cooling the inlet air or charged air from air induction system 24, and liquid-to-air heat exchangers 46, 48 for cooling a heat-transferring medium circulated throughout engine 12. It is contemplated that cooling system 26 may include additional and/or different components such as, for example, an oil cooler, an exhaust cooler, one or more valve mechanisms, one or more flow meters, and other cooling system components known in the art.

Fan 42 may produce a flow of air across air-to-air heat exchanger 44 and liquid-to-air heat exchangers 46, 48. In addition, fan 42 may be indirectly driven by engine 12 via an input device (not shown) such as, for example, a belt driven pulley, a hydraulically driven motor, or an electrically powered motor. Alternatively, fan 42 may be driven by a source independent of engine 12 such as, for example, a motor (not shown). Fan 42 may also include fan blades 50 fixedly or adjustably connected thereto. Fan 42 may be powered by engine 12 to cause fan blades 50 to blow air across air-to-air heat exchanger 44 and liquid-to-air heat exchangers 46, 48. It is contemplated that in an alternate embodiment, fan 42 may be situated to draw air from engine 12 across air-to air heat exchanger 44 and liquid-to-air heat exchangers 46, 48.

Air-to-air heat exchanger 44 may be situated downstream from fan 42 and may be oriented so that a maximum surface area may be exposed to the airflow generated by fan 42. In addition, air-to-air heat exchanger 44 may facilitate the transfer of heat from at least a portion of inlet air or charged air flowing through air induction system 24. Furthermore, air-to-air heat exchanger 44 may be fluidly connected to engine 12 via fluid conduits 38, 40. Inlet or charged air from air induction system 24 may enter air-to-air heat exchanger 44 through an inlet 52 fluidly connected to fluid conduit 38 and exit air-to-air heat exchanger 44 through an outlet 54 fluidly connected to fluid conduit 40. It is contemplated that air-to-air heat exchanger 44 may be any type of heat exchanger such as, for example, a tube-fin type heat exchanger, a bar plate type heat exchanger, or any other type of heat exchanger known in the art. Additionally, in embodiments where fan 42 may draw air across air-to air heat exchanger 44, air-to air heat exchanger 44 may be situated upstream of fan 42.

Liquid-to-air heat exchanger 46 may facilitate the transfer of heat to or from a portion of a heat-transferring medium circulated throughout engine 12 and may include, for example, a tube-fin type heat exchanger, a bar plate type heat exchanger, or any other type of heat exchanger known in the art. In addition, liquid-to-air heat exchanger 46 may be located downstream of and in series with air-to-air heat exchanger 44 relative to the flow of air generated by fan 42. Such a configuration may permit at least a substantial portion of air passing through air-to-air heat exchanger 44 to also pass through liquid-to-air heat exchanger 46. Furthermore, the orientation of liquid-to-air heat exchanger 46 may be substantially the same as the orientation of air-to-air heat exchanger 44. Additionally, in embodiments where fan 42 may draw air across Liquid-to-air heat exchanger 46, Liquid-to-air heat exchanger 46 may be situated upstream of fan 42.

Liquid-to-air heat exchanger 46 may be fluidly connected to engine 12 via a supply conduit 56 and a return conduit 58. The heat-transferring medium from engine 12 may enter liquid-to-air heat exchanger 46 through an inlet 60 fluidly connected to supply conduit 56 via a passage 62 and exit liquid-to-air heat exchanger 46 through an outlet 64 fluidly connected to return conduit 58 via a passage 66. Furthermore, a valve 68 may be situated within passage 62 or passage 66 and may regulate the flow of the heat-transferring medium to liquid-to-air heat exchanger 46. It is contemplated that valve 68 may be a simple on/off valve or a proportional-type valve.

Liquid-to-air heat exchanger 48 may also facilitate the transfer of heat to or from a heat-transferring medium circulated throughout engine 12 and may include, for example, a tube-fin type heat exchanger, a bar plate type heat exchanger, or any other type of heat exchanger known in the art. In addition, liquid-to-air heat exchanger 48 may be located so that at least a substantial portion of the air stream flowing through air-to-air heat exchanger 44 may not pass through liquid-to-air heat exchanger 48 and may not substantially affect liquid-to-air heat exchanger 48 thermally. Furthermore, the orientation of liquid-to-air heat exchanger 48 may be substantially the same as the orientations of air-to-air heat exchanger 44 and liquid-to-air heat exchanger 46. It is contemplated that although FIG. 2 illustrates liquid-to-air heat exchanger 48 being situated next to and substantially in the same plane as liquid-to-air heat exchanger 46, liquid-to-air heat exchanger 48 may be situated next to and substantially in the same plane as air-to-air heat exchanger 44, if desired. Additionally, in embodiments where fan 42 may draw air across Liquid-to-air heat exchanger 48, Liquid-to-air heat exchanger 48 may be situated upstream of fan 42.

Liquid-to-air heat exchanger 48 may be fluidly connected to engine 12 via supply conduit 56 and return conduit 58. The heat-transferring medium from engine 12 may enter liquid-to-air heat exchanger 48 through an inlet 70 fluidly connected to supply conduit 56 via a passage 72. In addition, the heat-transferring medium may exit liquid-to-air heat exchanger 48 through an outlet 74 fluidly connected to return conduit 58 via a passage 76.

In one exemplary embodiment, liquid-to-air heat exchangers 46, 48 may function as the main radiators of engine 12 dedicated to conditioning only the heat-transferring medium supplied to engine block 14 or, alternatively, the engine oil cooler, the transmission oil cooler, the brake oil cooler, or any other cooling component of engine 12. In addition, the heat-transferring medium may be any type of low-pressure fluid. Exemplary low-pressure fluids may include, for example, water, glycol, a water-glycol mixture, a blended air mixture, a power source fluid such as transmission oil, engine oil, brake oil, or diesel fuel, or any other low-pressure fluid known in the art for transferring heat.

Control system 28 may take any form such as, for example, a computer based system, a microprocessor based system, a microcontroller, or any other suitable control type circuit or system. Control system 28 may be located anywhere within machine 10 and may include various components for running software applications designed to regulate various subsystems of the machine 10. For example, control system 28 may include a central processing unit (CPU), a random access memory (RAM), input/output (I/O) elements, etc. In addition, control system 28 may include sensors 78, 80, 82, and 84 and a controller 86.

Control system 28 may regulate the operations of fan 42, air-to air heat exchanger 44 and liquid-to-air heat exchangers 46, 48 in response to the temperatures of the air around engine 12, the air flowing through air-to air heat exchanger 44, and the heat-transferring medium flowing through liquid-to-air heat exchangers 46, 48. Such temperatures may be sensed using any number of methods. For example, the temperatures may be directly sensed using sensors 78, 80, and 84. Alternatively, the temperatures may be indirectly sensed based on various parameters of machine 10. Such parameters may be compared to various charts, graphs, etc. that may be stored within a memory of controller 86, and the temperatures of the air around engine 12, the air flowing through air-to air heat exchanger 44, and the heat-transferring medium flowing through liquid-to-air heat exchangers 46, 48 may be calculated.

Sensor 78 may be located anywhere within fluid conduit 38 and may include one or more devices for sensing a parameter indicative of a temperature of the intake or charge air entering air-to-air heat exchanger 44, which may indicate an operating condition of air-to-air heat exchanger 44. In addition, sensor 78 may include any type of temperature sensing device known in the art. For example, sensor 78 may include a surface-type temperature sensing device that measures a wall temperature at inlet 52. Alternately, sensor 78 may include a air-type temperature sensing device that directly measures the temperature of the intake or charge air within inlet 52. Upon measuring the temperature of the intake or charge air, sensor 78 may generate an inlet air temperature signal and send this signal to controller 86 via a communication line 88, as is known in the art. This temperature signal may be sent continuously, on a periodic basis, or only when prompted to do so by controller 86, if desired. Furthermore, it is contemplated that sensor 78 may be located within outlet 54, if desired.

Sensor 80 may be located anywhere within supply conduit 56 and may include one or more devices for sensing a parameter indicative of a temperature of the heat-transferring medium entering liquid-to-air heat exchangers 46, 48. In addition, sensor 80 may include any type of temperature sensing device known in the art. For example, sensor 80 may include a surface-type temperature sensing device that measures a wall temperature of supply conduit 56. Alternately, sensor 80 may include a liquid-type temperature sensing device that directly measures the temperature of the heat-transferring medium within supply conduit 56. Upon measuring the temperature of the heat-transferring medium, sensor 80 may generate a heat-transferring medium temperature signal and send this signal to controller 86 via a communication line 90, as is known in the art. This temperature signal may be sent continuously, on a periodic basis, or only when prompted to do so by controller 82, if desired. Furthermore, it is contemplated that sensor 80 may be located within return conduit 58, if desired.

Sensor 82 may be associated with fan 42 to sense a rotational speed thereof and may be in communication with controller 86 via a communication line 92. In one example, sensor 82 may embody a magnetic pickup type of sensor associated with a magnet embedded within a rotational component of fan 42. During operation of fan 42, sensor 82 may sense the rotating magnetic field produced by the magnet and generate a signal corresponding to the rotational speed of fan 42.

Sensor 84 may be situated anywhere within an engine compartment (not shown) of machine 10 to sense the air around engine 12. In addition, sensor 84 may include any type of temperature sensing device known in the art. For example, sensor 84 may embody a thermocouple or a thermometer-type sensor. Upon measuring the temperature of the air, sensor 84 may generate an engine air temperature signal and send this signal to controller 86 via a communication line 94, as is known in the art. This temperature signal may be sent continuously, on a periodic basis, or only when prompted to do so by controller 86, if desired.

Controller 86 may include one or more microprocessors, a memory, a data storage device, a communication hub, and/or other components known in the art. Controller 86 may receive signals from sensors 78 and 80 and analyze the data to determine whether the temperature of the intake or charge air and/or heat transferring medium is within a desired temperature range by comparing the data to threshold temperatures stored in or accessible by controller 86. If the temperatures are not within the desired temperature range, controller 86 may compare data received from sensors 78, 80, 82, and 84 to algorithms, equations, subroutines, reference look-up maps or tables and establish an output to influence the operation of fan 42 and/or valve 68. For example, the rotational speed of fan 42 may be adjusted and/or valve 68 may be set to an open, closed, or intermediate position to regulate the flow of the heat transferring medium. The output may be conveyed hydraulically, pneumatically, or electronically. Alternatively, it is contemplated that controller 86 may receive signals from various sensors (not shown) located throughout air induction system 24, engine 12, and/or cooling system 26 instead of sensors 78, 80, 82, and 84. Such sensors may sense parameters that may be used to calculate the temperature of the intake or charge air entering air-to-air heat exchanger 44 and the heat-transferring medium flowing through supply conduit 56 and determine a course of action.

In an alternate embodiment, controller 86 may actuate fan 42 and/or valve 68 in response to various operating conditions of engine 12 instead of or in conjunction with the temperature of intake or charge air entering air-to-air heat exchanger 44 and/or the temperature of the heat-transferring medium flowing through supply conduit 56. For example, during an engine retarding operation, air induction system 24 may be less active, and the heat load of air-to-air heat exchanger 44 may be reduced. Therefore, upon determining that an engine retarding operation is being performed, it may be desired to increase the rotational speed of fan 42 and/or actuate valve 68 so that the heat-transferring medium may flow through both liquid-to-air heat exchangers 46 and 48 for maximum heat rejection. However, when air induction system 24 is active, the heat load of air-to-air heat exchanger 44 may be high and may adversely affect the operation of liquid-to-air heat exchanger 46. Because the heat rejection operation of liquid-to-air heat exchanger 46 may be compromised, the temperature of the heat-transferring medium flowing through supply conduit 56 may exceed a desired temperature. Therefore, upon determining that air induction system 24 may be active, it may be desired to actuate valve 68 to restrict the flow of the heat-transferring medium through liquid-to-air heat exchanger 46, thereby disabling liquid-to-air heat exchanger 46. It is contemplated that one exemplary method for determining whether or not air induction system 24 is active may include determining a rotational speed of compressor 30. In particular, if compressor 30 is rotating above a threshold speed, air induction system 24 may be active. In addition, if compressor 30 is rotating below a threshold speed or not rotating at all, air induction system 24 may be inactive. The speed of compressor 30 may be determined by analyzing signals received from various sensors (not shown) associated with compressor 30.

It is contemplated that machine 10 may include an exhaust gas recirculation system (not shown), which may utilize an exhaust gas recirculation (EGR) cooler (not shown) for cooling recirculated exhaust gas. The EGR cooler may be any type of heat exchanger such as, for example, an air-to-air heat exchanger or a liquid-to-air heat exchanger. In addition, similar to air-to-air heat exchanger 44, the EGR cooler may be situated upstream or downstream of liquid-to-air heat exchanger 46. During various engine operations, the EGR system may be less active, and the heat load of the EGR cooler may be reduced. With the reduced heat load from the EGR cooler, it may be more efficient to operate liquid-to-air heat exchanger 46. Therefore, upon determining that the EGR system is less active, it may be desired to increase the rotational speed of fan 42 and/or actuate valve 68 so that the heat-transferring medium may flow through both liquid-to-air heat exchangers 46 and 48 for maximum heat rejection. However, when the EGR system is active, the heat load of the EGR cooler may be high and may adversely affect the operation of liquid-to-air heat exchanger 46. Because the heat rejection operation of liquid-to-air heat exchanger 46 may be compromised, the temperature of the heat-transferring medium flowing through supply conduit 56 may exceed a desired temperature. Therefore, upon determining that the EGR system may be active, it may be desired to actuate valve 68 to restrict the flow of the heat-transferring medium through liquid-to-air heat exchanger 46, thereby disabling liquid-to-air heat exchanger 46. It is contemplated that one exemplary method for determining whether or not the EGR system is active may include determining a position of an EGR valve (not shown) that may regulate the flow of exhaust gas through the EGR system.

It is further contemplated that machine 10 may include a hydrostatic fluid system (not shown), which may utilize a hydrostatic fluid cooler (not shown) for cooling a hydrostatic fluid flowing through the hydrostatic system. The hydrostatic fluid cooler may be any type of heat exchanger such as, for example, a liquid-to-air heat exchanger. In addition, similar to air-to-air heat exchanger 44, the hydrostatic fluid cooler may be situated upstream or downstream of liquid-to-air heat exchanger 46. During various engine operations, the hydrostatic fluid system may be less active, and the heat load of the hydrostatic fluid cooler may be reduced. With the reduced heat load from the hydrostatic fluid cooler, it may be more efficient to operate liquid-to-air heat exchanger 46. Therefore, upon determining that the hydrostatic fluid system is less active, it may be desired to increase the rotational speed of fan 42 and/or actuate valve 68 so that the heat-transferring medium may flow through both liquid-to-air heat exchangers 46 and 48 for maximum heat rejection. However, when the hydrostatic fluid system is active, the heat load of the hydrostatic fluid cooler may be high and may adversely affect the operation of liquid-to-air heat exchanger 46. Because the heat rejection operation of liquid-to-air heat exchanger 46 may be compromised, the temperature of the heat-transferring medium flowing through supply conduit 56 may exceed a desired temperature. Therefore, upon determining that the hydrostatic fluid system may be active, it may be desired to actuate valve 68 to restrict the flow of the heat-transferring medium through liquid-to-air heat exchanger 46, thereby disabling liquid-to-air heat exchanger 46. It is contemplated that one exemplary method for determining whether or not the hydrostatic fluid system is active may include determining a fluid flow within the hydrostatic fluid system. Any flows above a predetermined threshold may indicate that the hydrostatic fluid system may be active.

Figure 3:
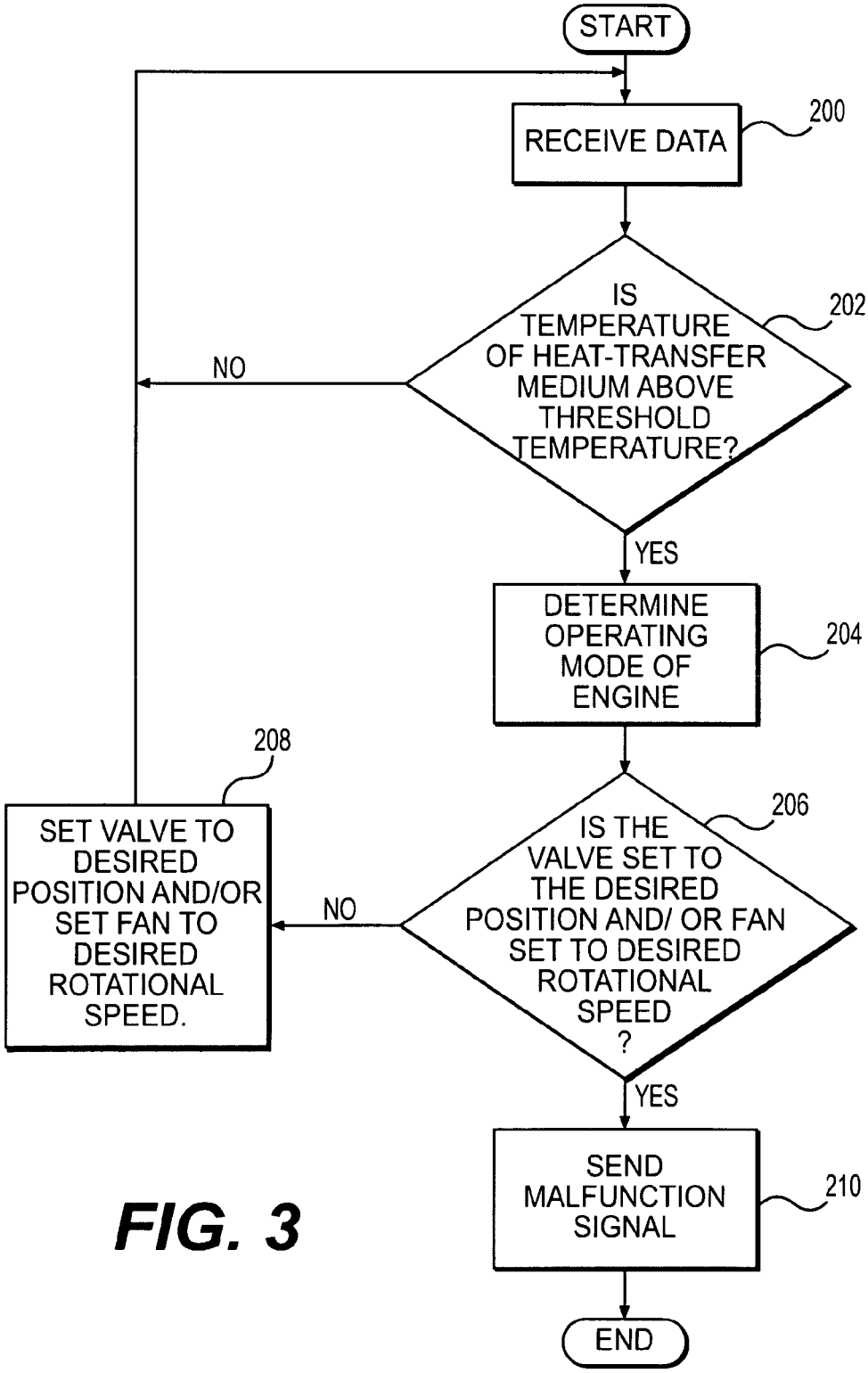
FIG. 3 is a flow diagram of an exemplary method for operating the cooling system of FIG. 2.

FIG. 3, which is discussed in the following section, illustrates the operation of cooling system 26. FIG. 3 illustrates an exemplary method for regulating the flow of fluids through cooling system 26.

INDUSTRIAL APPLICABILITY

The disclosed cooling system may be used in any machine or power system application where multiple heat exchangers must be closely packaged and efficient heat dissipation is important. In particular, the disclosed cooling system may provide unique exchanger packaging strategy that improves dissipation effectiveness within a confined space. The operation of cooling system 26 will now be described.

FIG. 3 illustrates a flow diagram depicting an exemplary method for regulating the flow of fluid through cooling system 26. The method may begin when controller 86 receives signals from sensors 78, 80, 82, and 84 (step 200). The signals may be indicative of a temperature of the intake or charge air flowing through fluid conduit 40, a temperature of the heat-transferring medium flowing through supply conduit 56, a rotational speed of fan 42, and a temperature of the air surrounding engine 12. Alternatively, it is contemplated that controller 86 may receive signals from various sensors (not shown) located throughout air induction system 24, engine 12, and/or cooling system 26 instead of sensors 78, 80, 82, and 84. Such sensors may sense parameters that may be used to calculate the above-mentioned parameters.

After receiving the data signals, controller 86 may determine if the sensed temperature of the heat-transferring medium is greater than a threshold temperature (step 202). The threshold temperature may be any value above which, the heat-transferring medium may not adequately cool engine 12 and/or any other system being cooled by the heat-transferring medium. If controller 86 determines that the temperature of the heat-transfer medium is less than the temperature threshold (step 202: No), step 200 may be repeated (i.e., controller 86 may receive signals from sensors 78, 80, 82, and 84).

If controller 86 determines that the temperature of the heat-transferring medium is greater than the threshold temperature (step 202: Yes), controller 86 may determine an operating mode of engine 12 (step 204). For example, controller 86 may determine whether or not air intake system 24 is active, whether or not engine 12 is performing a retarding operation, or whether or not any other operation is being performed. Such a determination made be made via various sensors located throughout machine 10. For example, any rotational speed of compressor 30 may indicate that air induction system may be active. In addition, if a speed of engine 12 is above a threshold without receiving fuel from a fuel system, engine 12 may be performing a retarding operation.

After determining the operating mode of engine 12, controller 86 may determine whether or not valve 68 is set to a desired position and/or fan 42 is rotating at a desired speed (step 206). The desired position of valve 68 and rotational movement of fan 42 may depend on the temperature of the heat-transferring medium flowing through supply conduit 56, the operating status of engine 12, and/or the temperature of air surrounding engine 12. For example, if air induction system 24 is active, air-to-air heat exchanger 44 may be rejecting heat. Because liquid-to-air heat exchanger 46 may be situated downstream from air-to-air heat exchanger 44, the heat rejected by air-to-air heat exchanger 44 may adversely affect the heat rejecting capability of liquid-to-air heat exchanger 46. Therefore, it may be desired to set valve 68 to a position that may direct substantially all of the heat-transferring medium through liquid-to-air heat exchanger 48. In addition, if air induction system 24 is inactive, air-to-air heat exchanger 44 may be rejecting little or no heat. Therefore, valve 68 may be set to a position that may direct the heat-transferring medium through both liquid-to-air heat exchangers 46, 48.

If controller 86 determines that valve 68 is not set to the desired position and/or fan 42 is not set to the desired rotational speed (step 206: No), controller 86 may set valve 68 to the desired position and/or set fan 42 to the desired rotational speed (step 208). After setting valve 68 to the desired position and/or setting fan 42 to the desired rotational speed, step 200 may be repeated (i.e., controller 86 may receive signals from sensors 78, 80, 82, and 84). However, if controller 86 determines that valve 68 is set to the desired position and fan 42 is set to the desired rotational speed (step 206: Yes), controller 86 may send a malfunction signal to the operator (step 210). Because valve 68 may be set to the desired position and fan 42 may be set to the desired rotational speed, cooling system 26 may be operating at its maximum heat rejecting capacity. If the temperature of the heat-transferring medium flowing through supply conduit 56 is still above the threshold temperature, cooling system 26 may not be able to handle the current heat load. The malfunction signal may be sent to an operator interface (not shown) such as, for example, a computer monitor, a dashboard control panel, or any other user interface known in the art. It is contemplated that in addition to sending a malfunction signal, controller 86 may shut down engine 12 so to prevent any damage that may occur due to increased temperatures. After sending the malfunction signal and/or shutting down engine 12, the method may be terminated.

By utilizing a configuration including a first and second heat exchanger situated side-by-side and a third heat exchanger situated upstream of the first heat exchanger, the size of the heat exchanger package may be reduced while the cooling system efficiency may increase. In particular, because the first heat exchanger may be selectively disabled when the third heat exchanger is active, the cooling system may account for engine operating conditions where the radiator and charge air heat loads increase or decrease together as well as engine operating conditions where the radiator and charge air increase or decrease independently.

It will be apparent to those skilled in the art that various modifications and variations can be made in the disclosed system without departing from the scope of the disclosure. Other embodiments will be apparent to those skilled in the art from consideration of the specification disclosed herein. It is intended that the specification and examples be considered as exemplary only, with a true scope being indicated by the following claims and their equivalents.

What is claimed is:

1. A cooling system, comprising:

a first heat exchanger configured to remove heat from at least a portion of a first fluid;

a second heat exchanger configured to remove heat from a first portion of a second fluid, the second heat exchanger being located downstream of the first heat exchanger relative to a flow of air passing through the first heat exchanger so that a substantial portion of the air passing through the first heat exchanger also passes through the second heat exchanger;

a third heat exchanger configured to remove heat from a second portion of the second fluid;

a valve located to regulate the flow of the second fluid through the second heat exchanger and the third heat exchanger; and a controller configured to actuate the valve to regulate the flow of the second fluid through the second heat exchanger and the third heat exchanger based on operation of the first heat exchanger.

2. The cooling system of claim 1, wherein the third heat exchanger is positioned relative to the first and second heat exchangers so that at least a substantial portion of the air passing through the first heat exchanger does not pass through the third heat exchanger.

3. The cooling system of claim 1, wherein the second and third heat exchangers are configured to receive portions of the second fluid from one source.

4. The cooling system of claim 3, wherein the third heat exchanger is configured to receive portions of the second fluid directed away from the second heat exchanger.

5. The cooling system of claim 4, wherein the second heat exchanger is configured to receive portions of the second fluid directed away from the third heat exchanger.

6. The cooling system of claim 1, wherein the first heat exchanger is an air-to-air heat exchanger and the second and third heat exchangers are liquid-to-air heat exchangers.

7. The cooling system of claim 1, wherein the second heat exchanger and the third heat exchanger are situated in a side-by-side arrangement.

8. A method of cooling a fluid, comprising:

directing at least a portion of a first fluid through a first heat exchanger;

directing a first portion of a second fluid through a second heat exchanger;

directing air across the first and second heat exchangers so that the first and second heat exchangers receive the air in series;

directing a second portion of the second fluid through a third heat exchanger;

sensing a parameter indicative of an operating condition of the first heat exchanger; and regulating the flow of the portions of the second fluid through the second heat exchanger and the third heat exchanger in response to the operating condition of the first heat exchanger.

9. The method of claim 8, wherein regulating the flow of the portions of the second fluid includes restricting the flow of the second fluid through the second heat exchanger and the third heat exchanger based on heat removed from the first fluid by the first heat exchanger.

10. The method of claim 9, wherein the parameter indicative of the operating condition of the first heat exchanger is an operating mode of an associated engine.

11. The method of claim 9, wherein the parameter indicative of the operating condition of the first heat exchanger is an operating status of an air induction system of an associated engine.

12. The method of claim 9, wherein restricting the flow of the of the second fluid through the second heat exchanger and the third heat exchanger includes disabling the flow of the second fluid through one of the second heat exchanger and the third heat exchanger based on heat removed from the first fluid by the first heat exchanger.

13. The method of claim 8, further including directing through the third heat exchanger portions of the second fluid directed away from the second heat exchanger.

14. The method of claim 13, further including directing through the second heat exchanger portions of the second fluid directed away from the third heat exchanger.

15. A machine, comprising:

an engine;

an air induction system; and a cooling system, including:

a first heat exchanger configured to remove heat from at least a portion of an intake air stream flowing through the air induction system;

a second heat exchanger configured to remove heat from a portion of an engine cooling fluid, the second heat exchanger being located downstream of the first heat exchanger relative to the flow of air passing through the first heat exchanger so that a substantial portion of the air passing through the first heat exchanger also passes through the second heat exchanger;

a valve located to regulate the flow of the engine cooling fluid through the second heat exchanger; and a controller configured to actuate the valve to direct the flow of the engine cooling fluid away from the second heat exchanger based on the first heat exchanger removing heat from intake air flowing through the air induction system.

16. The machine of claim 15, further including a third heat exchanger positioned relative to the first and second heat exchangers so that at least a substantial portion of the air passing through the first heat exchanger does not pass through the third heat exchanger.

17. The machine of claim 16, wherein the third heat exchanger is configured to remove heat from at least a portion of the engine cooling fluid.

18. The machine of claim 17, wherein the third heat exchanger is configured to receive a portion of the engine cooling fluid directed away from the second heat exchanger.

19. The machine of claim 18, wherein the second heat exchanger is configured to receive a portion of the engine cooling fluid directed away from the third heat exchanger.

20. The machine of claim 19, wherein the first heat exchanger is an air-to-air heat exchanger and the second and third heat exchangers are liquid-to-air heat exchangers.

* * * * *